US005232659A

United States Patent [19]

Brown

[11] Patent Number: 5,232,659

[45] Date of Patent: Aug. 3, 1993

[54] METHOD FOR ALLOYING LITHIUM WITH POWDERED ALUMINUM

[76] Inventor: Sanford W. Brown, 1923 Cerro Gordo St., Mojave, Calif. 93501

[21] Appl. No.: 905,515

[22] Filed: Jun. 29, 1992

[51] Int. Cl.[5] ..... B22F 3/12

[52] U.S. Cl. ..... 419/36; 428/570; 75/343

[58] Field of Search ..... 419/36, 63, 64, 65; 428/570; 75/343

[56] References Cited

U.S. PATENT DOCUMENTS

| | | | |
|---|---|---|---|
| 2,849,309 | 8/1958 | Whaley | 75/135 |
| 2,929,126 | 3/1960 | Bollack et al. | 25/157 |
| 2,978,304 | 4/1961 | Cox | 75/53 |
| 3,041,164 | 6/1962 | Cox | 75/134 |
| 3,410,684 | 11/1968 | Printz | 75/214 |
| 3,442,923 | 5/1969 | Gray | 260/437 |
| 3,492,114 | 1/1970 | Schneider | 75/53 |
| 3,563,730 | 2/1971 | Bach et al. | 75/135 |
| 4,158,689 | 6/1979 | Pett et al. | 264/63 |
| 4,225,345 | 8/1980 | Adee et al. | 75/211 |
| 4,248,630 | 2/1981 | Balmuth | 75/135 |
| 4,389,240 | 2/1983 | Erich et al. | 419/23 |
| 4,389,241 | 6/1983 | Schelleng | 75/0.5 R |
| 4,532,106 | 7/1985 | Pickens | 420/528 |
| 4,556,535 | 12/1985 | Bowman et al. | 420/580 |
| 4,721,599 | 1/1988 | Nakamura | 419/23 |
| 4,765,950 | 8/1988 | Johnson | 419/2 |
| 4,902,471 | 2/1990 | Penkunas et al. | 419/33 |
| 4,946,499 | 8/1990 | Sakuranda et al. | 73/343 |

*Primary Examiner*—Donald P. Walsh
*Assistant Examiner*—Daniel Jenkins
*Attorney, Agent, or Firm*—Donald Diamond

[57] ABSTRACT

A powdered aluminum composition is mixed with lithium dispersed in an inert, non-water absorbent, liquid medium to produce a substantially homogenous admixture that is heated to melt the lithium and vaporize the liquid medium to thereby obtain a decovered powdered alloy comprising aluminum and lithium. The liquid medium has major and minor liquid constituents, wherein the major liquid constituent has a boiling point below the melting point of lithium and the minor liquid constituent has a boiling point above the melting point of lithium but below the melting point of the alloy being produced.

16 Claims, No Drawings

METHOD FOR ALLOYING LITHIUM WITH POWDERED ALUMINUM

BACKGROUND OF THE INVENTION

1. Field of the Invention

This invention relates to powdered alloys and, more particularly, to a method for alloying lithium with a powdered aluminum composition.

2. Prior Art

There has been an ongoing effort to develop high strength aluminum alloys that would be characterized by stronger, stiffer and lighter weight properties and which would be adapted for use in diverse areas such as aircraft, aerospace, automotive, naval, and electrical industries. While high strength is particularly important, the aluminum alloy must also meet a combination of property requirements such as density, strength, ductility, toughness, fatigue and corrosion resistance, with specific requirements being a function of the end use of the alloy. It is known in the art that high strength, lighter weight aluminum alloys can be obtained by alloying aluminum with lithium and that one or more additional alloying elements can be included in the alloys to provide suitable properties for particular end uses.

The general characteristics of aluminum-lithium alloys are described in the Encyclopedia Of Science And Chemical Technology, 6th Ed., 1987, Vol. 1 at Page 426. In this reference, it is disclosed that the addition of lithium to aluminum provides an alloy that is characterized by low density, an increase in elastic modulus (stiffness), and an increase in strength. It is pointed out that lithium is the lightest metal in existence and that for each weight percent of lithium added to aluminum, there is a corresponding decrease of 3% (theoretical is 5%) in the alloy's weight. It is noted that as the amount of lithium in the alloy is increased, there is a corresponding increase in strength due to the presence of very small precipitates which act as strengthening agents with respect to the aluminum and that as the precipitates grow during heat treatment, the strength increases to a limit and then begins to decrease. Accordingly, it is pointed out that aluminum-lithium alloys come under the classification of precipitation-strengthening alloys and that they are also classifiable as heat-treatable because the size and distribution of the precipitates can be controlled by heat treating. Also, it is reported that the addition of lithium to aluminum results in an alloy with unacceptable (low) levels of ductility for many applications and, therefore, other elements such as copper, magnesium and zirconium have been included in the alloy to offset the loss in ductility; however, it is further reported that these alloy additions, particularly copper, increase the alloy density and, therefore, the development of alloy formulations has focused on balancing the various positive and negative attributes of the different elements, to arrive at a composition with suitable properties.

Diverse methods are disclosed in the prior art for alloying lithium with aluminum. These methods include the following processing technologies: (a) combining molten lithium with powdered aluminum, (b) combining molten lithium with molten aluminum, and (c) mechanically combining powdered lithium with powdered aluminum.

A. COMBINING MOLTEN LITHIUM WITH POWDERED ALUMINUM

U.S. Pat. 3,563,730 (Bach et al., 1971) discloses a method for preparing aluminum-lithium alloys in particulate form which comprises mixing a dispersion of molten lithium in mineral oil with powdered aluminum at a temperature above the melting point of lithium but below the melting point of the alloy to be produced, and continuing the mixing until alloying has been effectively achieved. The powdered aluminum has a particle size from about 1 to about 100 microns and, preferably, from about 10 to about 40 microns. The concentration of lithium in the dispersion of lithium in mineral oil is from about 5 to about 15%, by weight. The alloying reaction is desirably carried out at about 250° C. and desirably not in excess of about 300° C. The aluminum-lithium alloy, as prepared, is generally in the form of finely divided particles which can be kept or stored in mineral oil or the alloy can be separated from the mineral oil as dry particulate material or powder by washing the dispersion with pentane or hexane.

U.S. Pat. 4,389,240 (Erich et al., 1983) discloses a process for producing a powderable alloy of aluminum and lithium which comprises mixing and heating powdered aluminum with lithium in a dry helium atmosphere and at a temperature above the melting point of lithium but below the melting point of the alloy to be produced as, for example, 288° C. to obtain an agglomerated friable mass.

U.S. Pat. 4,389,241 (Schelleng, 1983) discloses a process for preparing aluminum-lithium alloys in powdered form wherein mechanically milled aluminum powder is exposed to molten lithium in an inert liquid medium as described in U.S. Pat. 3,563,730 or in a dry, inert atmosphere as described in a U.S. Pat. 4,389,240, at a temperature in the range of 200° C. to 300° C., whereby the lithium is rapidly taken up by the mechanically milled aluminum.

B. COMBINING MOLTEN LITHIUM WITH MOLTEN ALUMINUM

U.S. Pat. 4,248,630 (Balmuth, 1981) discloses a method for preparing an aluminum-lithium alloy which comprises adding to molten aluminum at least one alloying element having a relatively low reactance with oxygen, such as manganese, degassing and filtering the molten alloy to remove undesirable hydrogen and dross, admixing molten lithium with the molten aluminum alloy in an inert atmosphere, bubbling inert gas through the resulting melt to remove dissolved gases and high pressure contaminants, and casting the melt to form an ingot.

U.S. Pat. 4,556,535 (Bowman et al., 1985) discloses a process for continuous in-line addition of molten lithium to a molten aluminum stream to form an aluminum-lithium alloy, while minimizing oxidation losses, skim formation and hydrogen gas absorption by the molten mixture, which comprises continuously adding molten lithium beneath the surface of continuously agitated molten aluminum with continuous monitoring of the flow rate of the molten lithium feed, bubbling a mixture of argon and chlorine gases through the molten aluminum-lithium alloy to remove impurities including hydrogen, continuously testing an aluminum-lithium alloy ingot while monitoring the ingot casting rate of the molten alloy, and adjusting the in-line flow rate of molten lithium based on the monitored ingot casting rate and the molten lithium flow rate to maintain a predetermined concentration of lithium in the alloy ingot being cast.

C. MECHANICALLY COMBINING POWDERED LITHIUM WITH POWDERED ALUMINUM

U.S. Pat. 4,532,106 (Pickens, 1985) discloses a powder metallurgy method for producing a consolidated aluminum-lithium product having high strength and high specific modulous which comprises milling, in an inert atmosphere, a powder charge containing lithium, oxygen, carbon, aluminum, and a process control agent to provide a mechanically alloyed powder, vacuum degassing the powdered alloy, with or without compaction, at a temperature from about 220° C. to about 600° C., compacting the degassed product at a temperature from about 220° C. to about 600° C. and extruding the compacted product at a temperature from about 315° C. to about 510° C.

SUMMARY OF THE INVENTION

In accordance with this invention, there is provided a method for alloying lithium with a powdered aluminum composition which comprises (a) mixing a powdered aluminum composition with lithium dispersed in an inert, non-water absorbent, liquid medium to obtain a substantially homogenous admixture, wherein the liquid medium has major and minor liquid constituents, with the major liquid constituent having a boiling point below the melting point of lithium and the minor liquid constituent having a boiling point above the melting point of lithium but below the melting point of the alloy being produced, and (b) heating the admixture to melt the lithium and vaporize the liquid medium to thereby obtain a decovered powdered alloy comprising aluminum and lithium.

DETAILED DESCRIPTION

The lithium dispersion which can be used in the practice of this invention to prepare aluminum-lithium alloys comprises lithium dispersed in an inert, non-water absorbent, liquid medium which has major and minor liquid constituents. A principal characteristic of the major liquid constituent is that it has a boiling point below the melting point of lithium. A principal characteristic of the minor liquid constituent is that it has a boiling point above the melting point of lithium but below the melting point of the alloy being produced. The melting point of lithium is 179° C. (354° F.).

The major liquid constituent, which advantageously has a boiling point from about 65° C. (149° F.) to about 150° C. (302° F.), is generally present in the lithium dispersion in an amount from about 0.5 to about 2.0 parts by weight per 1.0 part by weight of lithium and, preferably, is present in the lithium dispersion in an amount from about 0.75 to about 1.5 parts by weight per 1.0 part by weight of lithium. The inert, non-water absorbent, major liquid constituent is, desirably, a liquid hydrocarbon selected from the group consisting of aliphatic compounds, aromatic compounds and ixtures thereof. A preferred major liquid constituent is hexane.

The minor liquid constituent, which advantageously has a boiling point above the melting point of lithium but below the melting point of the alloy being formed, is generally present in the lithium dispersion in an amount from about 0.03 to about 0.12 part by weight per 1.0 part by weight of lithium and, preferably, is present in the lithium dispersion in an amount from about 0.05 to about 0.09 part by weight per 1.0 part by weight of lithium. A preferred minor liquid constituent is mineral oil, a liquid hydrocarbon composition having a boiling point range from about 330° C. (626° F.) to about 390° C. (734° F.).

The powdered aluminum compositions which can be used in the practice of this invention can have a particle size range from +40 to −325 mesh. The powdered aluminum composition can be (a) substantially powdered aluminum or (b) powdered aluminum blended with one or more powdered alloying elements such as silicon, iron, copper, manganese, magnesium, chromium, nickel, zinc, gallium, vanadium, titanium, zirconium, tin, cobalt, boron, bismuth, lead, or beryllium, or (c) a pre-alloyed powdered aluminum composition containing one or more of the aforesaid alloying elements, or (d) a mixture of any of the foregoing.

In carrying out the method of this invention for alloying lithium with a powdered aluminum composition, the powdered aluminum composition is mixed with the lithium dispersion to obtain a substantially homogenous admixture which is heated to melt the lithium and vaporize the liquid constituents of the lithium dispersion to thereby obtain a decovered powdered alloy comprising aluminum and lithium. The amount of lithium used in the alloying procedure is so selected as to provide the powdered alloy with a lithium concentration in an amount from about 0.5 to about 7.0 percent by weight. As to other alloying elements that can be advantageously included in the admixture which defines the alloy precursor, their concentration is so selected as to provide the powdered alloy with suitable properties for particular end uses. When the minor liquid constituent in the lithium dispersion is mineral oil, the admixture is advantageously heated to about 400° C. (752° F.) to melt the lithium and vaporize the liquid constituents.

Following alloy formation, the powdered aluminum-lithium alloy is poured into a compaction die and compacted to at least 85% of theoretical density by employing a suitable compaction force as, for example, 15 tons per square inch. The resulting compaction product or billet may be further compacted to at least about 98% of theoretical density by subjecting the billet to a second compaction step. Upon completion of the compaction process, the billet is sintered at a temperature from about 516° C. (960° F.) to about 571° C. (1060° F.) for about 30 minutes. Thereafter, the sintered billet can be extruded at a suitable temperature as, for example, a temperature of about 460° C. (860° F.) to form preselected tubular configurations that can be used in diverse applications, including sporting goods such as archery arrows and golf club shafts.

The following examples further illustrate the method of this invention.

EXAMPLE I

A powdered aluminum composition was prepared by blending the following powdered ingredient in a "V" blender at 20 rpm for 30 minutes:

| Ingredients | Wt., Grams | Mesh Size |
|---|---|---|
| Aluminum | 2,000 | +40 to −325 |
| Magnesium | 12 | −325 |
| Iron | 2 | −325 |
| Chromium | 2 | −325 |
| Copper | 6 | −325 |

The blended powder was transferred to a mixing and heating, round bottom, stainless steel bowl and a lithium dispersion containing 40 grams of lithium powder, 40 grams of mineral oil and 80 grams of hexane was admixed with the blended powder to obtain a substantially homogenous admixture which was heated under a hood at 750° F. (399° C.) until vaporization of the liquid components ceased, about 30 minutes.

The resulting powdered alloy comprising aluminum and lithium was cooled, placed in a compaction die and compacted into a billet at a compaction force of about 15 tons per square inch. Thereafter, the compacted billet was heated to 860° F. (460° C.) and extruded into a tubular configuration.

EXAMPLE II

Following the procedure of Example I, a powdered alloy was prepared by admixing (i) a powdered aluminum composition containing 2,000 grams of aluminum, 34 grams of magnesium, 12.6 grams of manganese, 3 grams of silicon and 40 grams of copper with (ii) a lithium dispersion containing 36 grams of lithium powder, 36 grams of mineral oil and 70 grams of hexane, and heating the admixture to vaporize the liquid components.

EXAMPLE III

Following the procedure of Example I, a powdered alloy was prepared by admixing (i) a powdered aluminum composition containing 2,000 grams of aluminum, 32 grams of copper, 50 grams of magnesium, 4 grams of chromium and 112 grams of zinc with (ii) a lithium dispersion containing 40 grams of lithium powder, 40 grams of mineral oil and 80 grams of hexane, and heating the admixture to vaporize the liquid components.

EXAMPLE IV

A powdered alloy was prepared in accordance with the procedure and ingredients of Example I except that the lithium dispersion contained 140 grams of lithium powder.

In view of the foregoing description and examples, it will become apparent to those of ordinary skill in the art that equivalent modifications thereof may be made without departing from the spirit and scope of this invention.

That which is claimed is:

1. A method for alloying lithium with a powdered aluminum composition, which comprises:

mixing a powdered aluminum composition with lithium dispersed in an inert, non-water absorbent, liquid medium to obtain a substantially homogenous admixture, said liquid medium comprising substantially mutually exclusive fractions of major and minor liquid constituents of differentiating boiling points, said major liquid constituent having a boiling point below the melting point of lithium, said minor liquid constituent having a boiling point above the melting point of lithium but below the melting point of the alloy being produced, and heating said admixture to melt said lithium and vaporize said liquid medium to thereby obtain a decovered powdered alloy comprising aluminum and lithium.

2. The method of claim 1 wherein the major liquid constituent has a boiling point from about 65° C. to about 150° C.

3. The method of claim 2 wherein the concentration of the major constituent is from about 0.5 to about 2.0 parts by weight per 1.0 part by weight of lithium.

4. The method of claim 2 wherein the concentration of the major liquid constituent is from about 0.75 to about 1.5 by weight per 1.0 part by weight of lithium.

5. The method of claim 3 wherein the major liquid constituent is a liquid hydrocarbon.

6. The method of claim 5 wherein the liquid hydrocarbon is a member selected from the group consisting of aliphatic compounds, aromatic compounds and mixtures thereof.

7. The method of claim 3 wherein the concentration of the minor liquid constituent is from about 0.03 to about 0.12 part by weight per 1.0 part by weight of lithium.

8. The method of claim 3 wherein the concentration of the minor liquid constituent is from about 0.05 to about 0.09 part by weight per 1.0 part by weight of lithium.

9. The method of claim 7 wherein the minor liquid constituent is mineral oil.

10. The method of claim 9 wherein the admixture is heated to at a temperature above the boiling point of mineral oil but below the melting point of the alloy being formed to melt the lithium and to vaporize the liquid constituents.

11. The method of claim 10 wherein the major liquid constituent is hexane.

12. The method of claim 1 wherein the powdered alloy comprising aluminum and lithium is compacted to at least about 85% of theoretical density.

13. The method of claim 12 wherein the compacted powdered alloy is sintered at a temperature from about 516° C. to about 571° C.

14. The method of claim 1 wherein the powdered aluminum composition comprises a pre-alloyed aluminum composition.

15. The method of claim 1 wherein the admixture includes an additional alloying ingredient selected from the group consisting of silicon, iron, copper, manganese, magnesium, chromium, nickel, zinc, gallium, vanadium, titanium, zirconium, tin, cobalt, boron, bismuth, lead, beryllium and mixtures thereof.

16. The method of claim 1 wherein the amount of lithium is so selected as to provide the powdered alloy with a lithium concentration in an amount from about 0.5 to about 7.0% by weight.

* * * * *